United States Patent [19]

Bredow et al.

[11] 4,380,182

[45] Apr. 19, 1983

[54] ARRANGEMENT FOR REPLACEABLY HOLDING A STRIPPER OF A TOOL HOLDER OF THE TOOL, AND A REPLACING TOOL FOR REPLACING THE STRIPPER

[75] Inventors: Walter Bredow; Gerhard Otto, both of Alfeld, Fed. Rep. of Germany

[73] Assignee: C. Behrens AG, Alfeld, Fed. Rep. of Germany

[21] Appl. No.: 225,966

[22] Filed: Jan. 14, 1981

[30] Foreign Application Priority Data

Feb. 15, 1980 [DE] Fed. Rep. of Germany ..... 3005613

[51] Int. Cl.[3] ..... B21D 45/00

[52] U.S. Cl. ..... 83/140; 83/552; 83/698; 279/77

[58] Field of Search ..... 83/140, 143, 146, 552, 83/698; 279/1 K, 77, 79; 29/268

[56] References Cited

U.S. PATENT DOCUMENTS 2,329,061 9/1943 Kopczynski ..... 83/140

3,540,339 11/1970 Killaly ..... 83/140

*Primary Examiner*—James M. Meister

*Attorney, Agent, or Firm*—Michael J. Striker

[57] ABSTRACT

A stripper arrangement for a tool includes a stripper, a stripper shoe mounted on a lower side of a tool holder of a tool and having an opening for receiving the stripper so that the latter can be inserted into the opening by movement in a plane transverse to the axis of the tool, a retaining member displaceable between an operative position in which it engages and retains the stripper and an inoperative position in which it does not engage the stripper, and a spring urging the retaining member to the operative position. An auxiliary tool for replacing the stripper has an abutment face arranged to abut against a lower side of the stripper, and a projection extending toward the stripper and arranged to displace the retaining member to its inoperative position so as to disengage the retaining member from the stripper. The auxiliary tool may also clamp the stripper for removal or insertion of the latter.

21 Claims, 7 Drawing Figures

ARRANGEMENT FOR REPLACEABLY HOLDING A STRIPPER OF A TOOL HOLDER OF THE TOOL, AND A REPLACING TOOL FOR REPLACING THE STRIPPER

BACKGROUND OF THE INVENTION

The present invention relates to an arrangement for replaceably holding a stripper on a tool holder of the tool for chipless working, particularly a revolving tool of a revolving cutting press. The invention also relates to a tool for replacing a stripper in the above-mentioned arrangement.

Tools or tool sets in metal working machines and particularly in revolving cutting presses generally include dies, punches and strippers. In revolving cutting presses it is conventional to mount the stripper directly below the revolving disc which serves as an upper disc or to insert the stripper in a so-called stripper shoe, when the stripper is spring-biased. The arrangement in accordance with the present invention deals with the above-mentioned tool holders. In the known stripper shoes, steel plates are utilized in cooperation with respective recesses for releasable mounting of the stripper. In the known arrangements, the stripper is retained in the stripper shoe with the aid of clamping screws. For replacing the stripper it is necessary to perform considerable mounting work which requires relatively high time expenditures. Moreover, there is a danger that during operation of the machine the clamping screws can loosen because of the vibrations and the stripper will unintentionally drop from the tool.

SUMMARY OF THE INVENTION

Accordingly, it is an object of the present invention to provide an arrangement for replaceably holding a stripper, which avoids the disadvantages of the prior art.

More particularly, it is an object of the present invention to provide an arrangement for replaceably holding a stripper which has a simple construction and allows easy and time economical replacement of the stripper.

In keeping with these objects and with others which will become apparent hereinafter, one feature of the present invention resides, briefly stated, in a stripper arrangement in which a stripper shoe has an opening for receiving a stripper arranged so that the stripper can be inserted into the opening by movement in a radial direction transverse to the axis of a tool and abut against an abutment wall portion of the stripper shoe, and a retaining member is provided which is deflectable in direction from the tool to an operative position in which the retaining member engages with and retains the stripper, and displaceable to an operative position in which the retaining member does not engage the stripper so that the latter can be withdrawn from the opening of the stripper shoe and replaced by a new stripper.

When the arrangement is designed in accordance with the present invention, the stripper can be inserted into the stripper shoe by displacement in the transverse direction and withdrawn from the stripper shoe by displacement in the opposite transverse direction. The stripper is reliably retained in the stripper shoe, and no additional mounting elements such as screws are needed for the retention. The stripper abuts against the abutment wall portion of the stripper shoe and thereby occupies a predetermined position.

The retaining member is spring biased in direction from the tool to the operative position. Thereby, when the stripper is inserted into the opening of the stripper shoe, the retaining member is automatically deflected from the tool and engages with the stripper so as to retain the latter in the stripper shoe. By displacement of the retaining member in the opposite direction, it releases the stripper and the latter can be easily withdrawn from the opening of the stripper shoe. These insertions and withdrawals can be easily performed from the periphery of the tool holder or the revolving tool.

In accordance with another advantageous feature of the present invention, the stripper and the stripper shoe are provided with means for positively connecting their lateral sides. This means can be formed by providing the lateral walls of the stripper and the stripper shoe with profiles extending in direction of insertion of the stripper into the stripper shoe. The profiles of the stripper and the profiles of the stripper shoe are complementary to each other and engage with one another so as to provide for the above-mentioned positive connection.

In accordance with still another especially advantageous feature of the present invention, the lateral walls of the stripper and the stripper shoe have an increasing cross-section in direction transverse to the direction of insertion of the stripper into the stripper shoe. This increasing cross-section may be continuous (stepless) or stepped. It is understood that the cross-section of the stripper and the cross-section of the stripper shoe are complementary to one another. These cross-sections may be dove-tail shaped or provided with a wider step facing toward the tool holder or the revolving tool. This makes possible especially reliable holding of the stripper with simultaneous simple insertion and withdrawal of the same.

In accordance with a further feature of the present invention, the stripper has lateral walls which converge toward one another in direction of insertion of the stripper into the stripper shoe, to the front abutment face of the stripper. In this case, the space below the tool holder or the revolving tool, especially the upper revolving tool, for the stripper can be utilized in optimum manner. Such a construction is also favorable for the replacement of the stripper in condition of the above-mentioned positive connection and guarantees that the positive connection is finally attained when the stripper is completely inserted in the stripper shoe and its abutment face abuts against the abutment wall portion of the opening in the stripper shoe.

In accordance with still a further feature of the present invention which provides for adjustment of the stripper in the stripper shoe, the retaining member is formed as a spring-biased catch supported on the stripper shoe. Such a catch can be easily deflected either manually or with the aid of a simple means and provides for a reliable arresting on the arresting edge of the stripper. Advantageously, the displacement of the catch is limited with the aid of an abutment lug provided on the catch and arranged to abut against a limiting projection provided on the stripper shoe, during the deflection of the catch to the operative position.

In order to guarantee reliable manipulation with the stripper during the replacement step, the stripper arrangement in accordance with still a further feature of the present invention has a recess provided in the stripper below the arresting edge of the latter so that an actuating member operative for displacement of the retaining member to the inoperative position can be received in the recess. This is favorable for the displacement of the retaining member or catch and can simultaneously serve for controlling the stripper during the replacement step.

An additional feature of the present invention resides in a tool for replacing a stripper, to be utilized in the above-described holding arrangement. In accordance with the invention, the tool has a front end provided with an abutment face arranged to abut against a lower side of the stripper, and a projection extending toward the stripper and arranged to displace the retaining member from the operative position to the inoperative position when the abutment face of the front end of the actuating member abuts against the lower side of the stripper.

When the tool is designed in accordance with the present invention it serves, on the one hand, for disengaging the retaining member or catch and, on the other hand, for controlling the stripper during the replacement step so that the stripper can be easily inserted or withdrawn by the replacing tool, and no additional steps are needed. The tool has a very simple construction.

In accordance with still an additional feature of the present invention, the abutment face and the projection are arranged at the end of one gripping portion of the replacing tool and the projection is formed as a pin which extends through an opening provided in the stripper. The gripping portion may also be provided with a second projection which is spaced from the first-mentioned projection and abuts against the rear end wall of the stripper. The pin displaces the retaining member to its inoperative position in which it does not engage with the stripper. At the same time the stripper is firmly held between the pin and the second projection so that the stripper can be easily inserted into the stripper shoe or withdrawn from the latter.

In accordance with another advantageous feature of the inventive replacing tool, the replacing tool may be formed as a prongs-type element and have two pivotable gripping arms which are spring biased toward one another. The front end of one of the arms can be provided with the above-mentioned projection for actuating the retaining member, whereas the front end of the other arm can be provided with the above-mentioned abutment face arranged to abut against a lower side of the stripper. When the projection displaces the retaining member to the inoperative position and the abutment face abuts against the lower side of the stripper, the stripper is clampingly gripped by the front ends of the arms. Thereby, the stripper is firmly retained by the displacing tool and can be inserted into the stripper shoe or withdrawn from the same by this tool.

The novel features which are considered as characteristic for the invention are set forth in particular in the appended claims. The invention itself, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
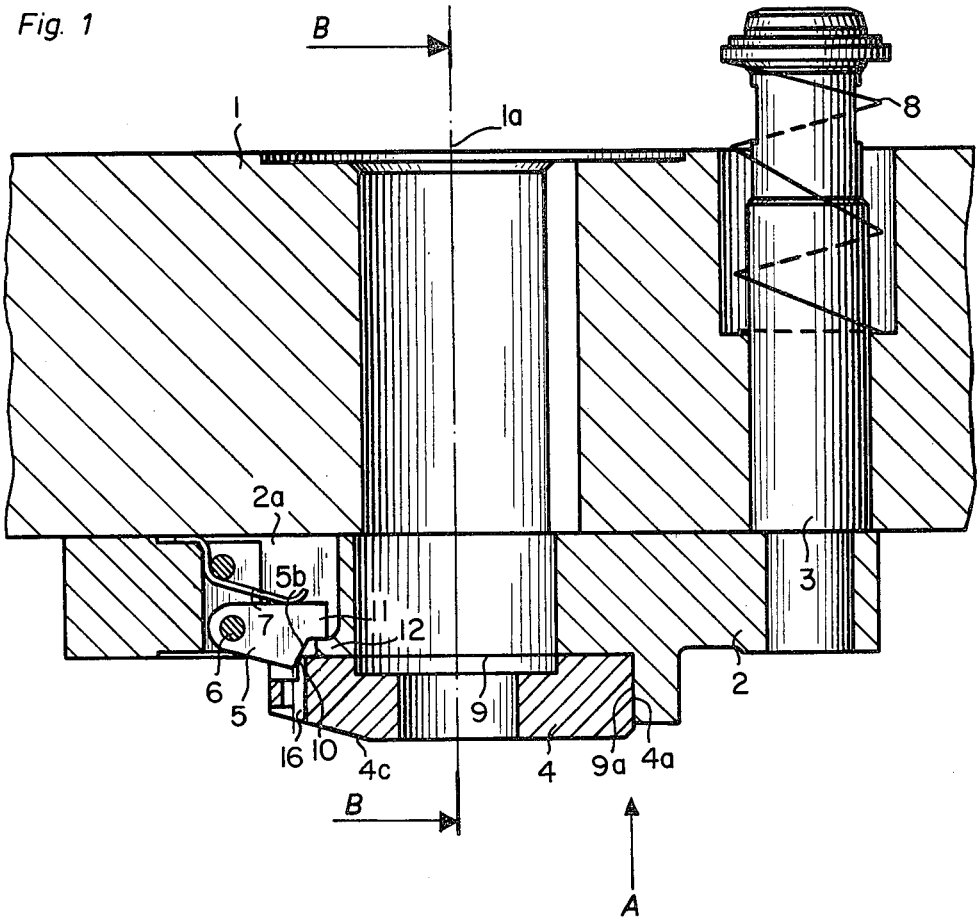
FIG. 1 is a view showing a longitudinal section of a holding arrangement for a stripper in accordance with the present invention, wherein the stripper is inserted in a stripper shoe and the latter is held on an upper revolving disc.

FIG. 1 shows a portion of a revolving disc 1 of a revolving cutting press, and a stripper shoe 2 which is mounted at the lower side of the revolving disc 1. The stripper shoe 2 is connected with the revolving disc 1 by three guiding pins 3 and retained in the shown normal position by helical springs 8.

The stripper shoe 2 is provided with a receiving recess 9 which extends toward the periphery of the revolving disc 1 and is open downwardly and toward the periphery. A stripper 4 is received in the receiving opening 9. The stripper 4 is inserted into the opening 9 by displacement in a plane which extends normal to a longitudinal tool axis 1*a* or parallel to the lower side of the revolving disc 1. The stripper shoe 2 has a wall which bounds the opening 9 and includes a curved abutment wall portion 9*a*. When the stripper 4 is inserted in the opening 9, an abutment face 4*a* of the stripper 4 abuts against the abutment wall portion 9*a* of the opening 9 of the stripper shoe 2. It is understood that the abutment face 4*a* and the abutment wall portion 9*a* have complementary contours.

Figure 2:
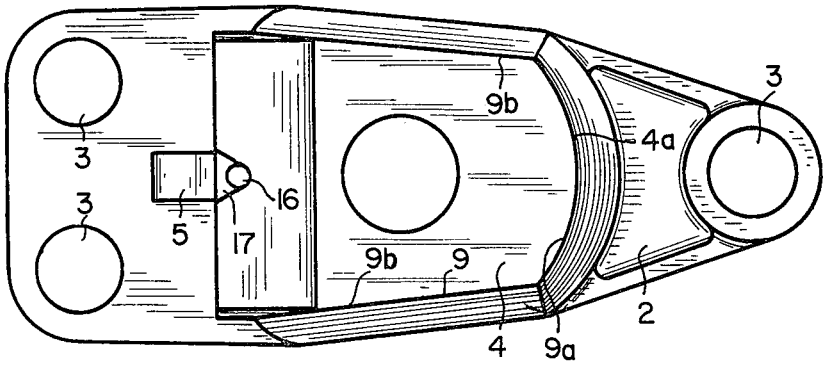
FIG. 2 is a plan view of the arrangement of FIG. 1 in direction of the arrow A, without the revolving disc.
Figure 3:
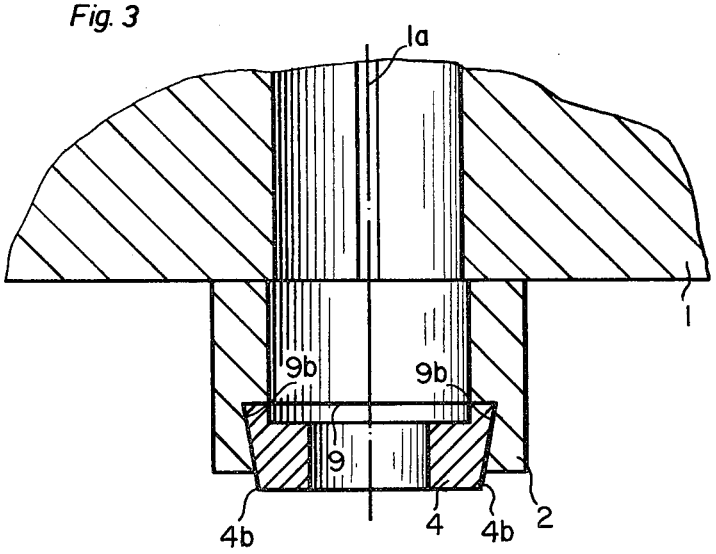
FIG. 3 is a view showing a section of the arrangement of FIG. 1, taken along the line B—B in accordance with a first embodiment of the invention.

The stripper 4 has lateral walls 4*b* which are profiled in direction of insertion of the stripper into the stripper shoe 2. The stripper shoe 2, in turn, has lateral walls 9*b* which are also profiled complementary to the profiled lateral walls 4*b* of the stripper 4. When the stripper 4 is inserted into the stripper shoe 2, the lateral walls 4*b* of the stripper and 9*b* of the stripper shoe engage with one another so as to provide positive connection between the stripper 4 and the stripper shoe 2. The positive connection in accordance with one embodiment of the invention is shown in FIGS. 1–3. The stripper 4 is substantially trapeze shaped in the direction of insertion, and the lateral walls 4*b* of the stripper 4 converge toward one another to the abutment face 4*a*. As can be seen from FIG. 3, the stripper 4 has a cross-section, in direction transverse to the direction of insertion, which continuously increases. The lateral walls 9*b* of the opening 9 of the stripper shoe 2 are formed complementary to the above-mentioned increasing cross-section of the stripper 4. Thereby, the lateral walls together form a dove-tail shaped connection.

Figure 4:
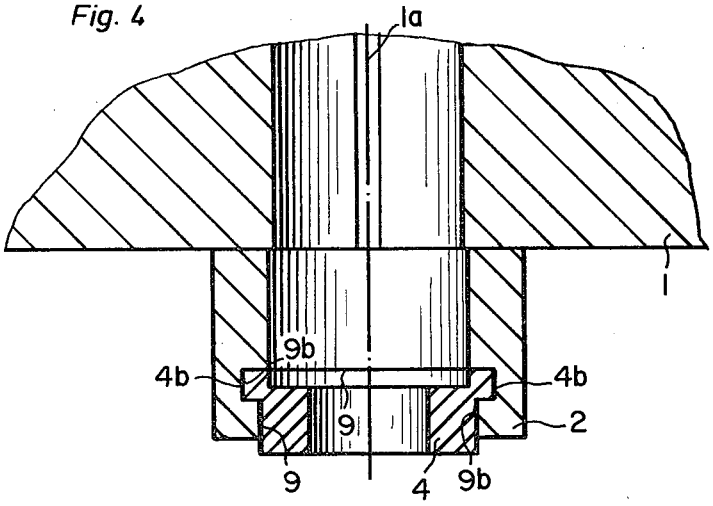
FIG. 4 is a view substantially corresponding to that of FIG. 3, but showing a second embodiment of the present invention.

As can be seen from FIG. 4, the lateral walls can be designed in a somewhat different manner. The lateral walls 4*b* of the stripper 4 have a cross-section which increases toward the revolving disc 1 in a stepped manner. The lateral walls 9*b* of the opening 9 of the stripper shoe has a cross-section corresponding to the stepped cross-section of the lateral walls 4b of the stripper 4. It is understood that such construction also provides for the above-mentioned positive connection between the stripper 4 and the stripper shoe 2.

It is believed to be clear from the preceding description and the drawings that the stripper can be easily inserted into the stripper shoe until it abuts against the abutment wall 9a so as to provide the positive connection with the stripper shoe. On the other hand, the stripper can be easily withdrawn from the stripper shoe.

In order to hold and arrest the stripper 4 in the illustrated operating position, a retaining member is provided in the inventive arrangement. The retaining member is formed as a catch 5 which is spring-biased in direction away from the revolving disc and toward the stripper. The catch 5 is pivotally mounted on the stripper shoe 2 with the aid of a pin 6 and moves in a recess 2a provided in the stripper shoe. A leaf spring 7 urges the catch 5 downwardly so that the latter deflects to its operative or arresting position. In this position the catch 5 engages with the stripper 4 and retains the same.

Other means can be utilized instead of the leaf spring 7, such as for example, torsion spring, helical springs, rubber springs or plastic springs.

The catch 5 has an arresting face 5b which abuts in the shown operative position against an arresting edge 10. The arresting edge 10 is provided on a rear wall which faces away from the abutment wall portion 9a of the stripper shoe 2. The deflection of the catch 5 to the operative or arresting position for engagement with the stripper 4 is limited by a limiting means. The limiting means includes an abutment lug 11 which is provided on the catch 5 and arranged to abut against a projection 12 of the stripper shoe 2 formed above the arresting edge 10. Thus, the stripper 4 is positively held in the stripper shoe 2 in the operative position shown in FIGS. 1–4 and arrested in this position by the catch 5.

For removing the stripper 4 from the stripper shoe 2 it suffices to displace the catch 5 against the action of the leaf springs 7 upwardly toward the revolving disc 1, until the abutment edge 10 is released. Thereafter the stripper 4 can be displaced from the opening 9 of the stripper shoe 2 toward the periphery of the revolving disc 1. The insertion of a new stripper can be performed in an extremely simple manner. The new stripper 4 is inserted into the opening 9 of the stripper shoe 2 with simultaneous displacement of the catch 5 upwardly toward the revolving disc 1 until the stripper 4 assumes its operative position shown in FIGS. 1 and 2. The catch 5 is deflected by the leaf spring 7 downwardly and set behind the arresting edge 10 so as to arrest the stripper 4. The longitudinal direction of the stripper shoe 2 or the stripper 4 and thereby the direction of insertion of the latter into the former advantageously corresponds to the radial direction of the revolving disc 1. A recess 16 is formed in the stripper 4 below the arresting edge 10 for receiving a replacing tool operative for displacement of the catch 5 from the operative position to the inoperative position in which the catch 5 does not engage the stripper 4.

Figure 5:
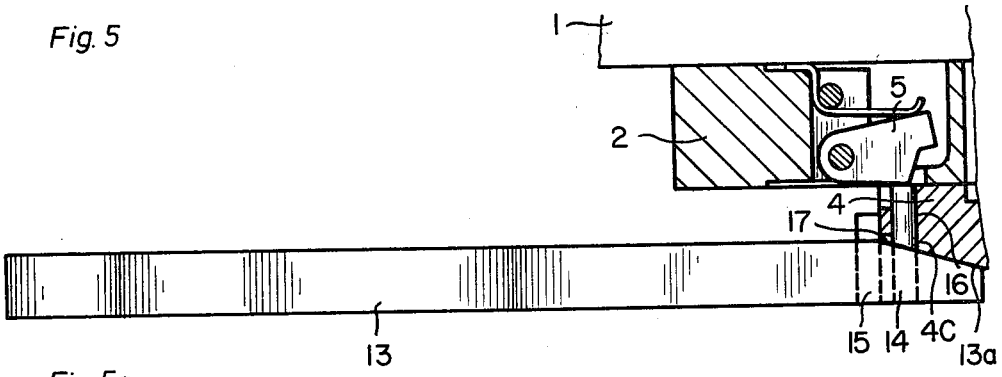
FIG. 5 is a side view of a tool for replacing the stripper, associated with the holding arrangement, in accordance with one embodiment of the invention.
Figure 5A:
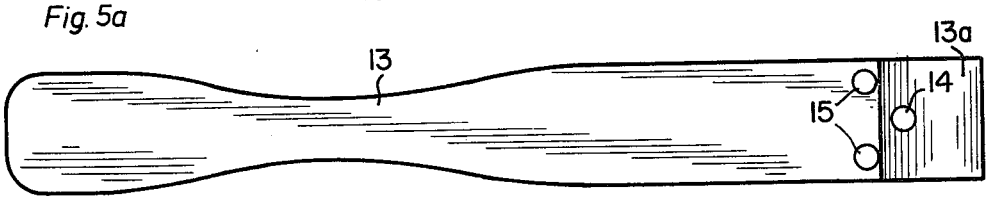
FIG. 5A is a plan view of the replacing tool of FIG. 5.

FIGS. 5 and 5A shows a simple tool or auxiliary tool which can be utilized with the above-described holding arrangement for replacing the stripper. The tool has a gripping portion 13 with a front end provided with an abutment face 13a. The front end is also provided with a projection which extends toward the stripper 4 and is formed as a pin 14. As can be seen from FIG. 5, the abutment face 13a of the gripping portion 13 abuts, during replacement of the stripper 4, against a respective inclined face 4c of the stripper 4. At the same time, the pin 14 is inserted in the opening 16 and displaces the catch 5 upwardly.

A second projection or two pins 15 is (are) further arranged on the gripping portion 13. They are spaced from the first-mentioned pin 14 and arranged to abut against the rear wall of the stripper 4 as shown in FIG. 5. The additional pins 15 prevent lateral turning out or swinging of the stripper 4 during the replacement step. When the replacing tool is placed on the arrangement as shown in FIG. 5, the stripper 4 can easily be withdrawn from the stripper shoe 2 by pulling of the gripping portion 13. A new stripper can be inserted into the stripper shoe in reversed order.

Figure 6:
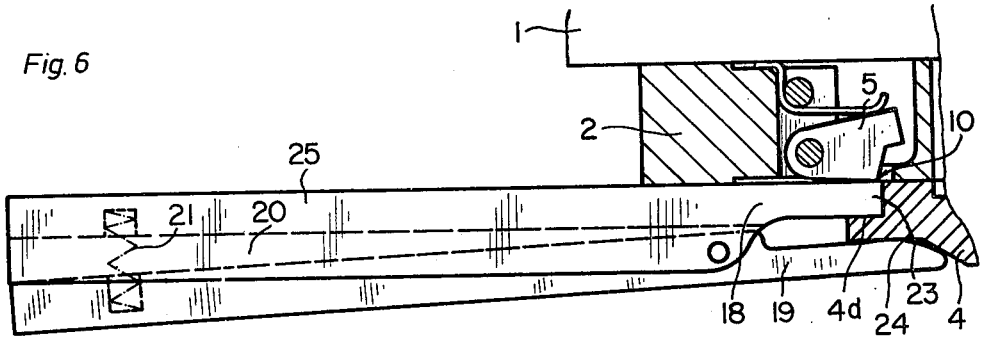
FIG. 6 is a view substantially corresponding to that of FIG. 5, but showing a replacing tool in accordance with another embodiment of the present invention.

FIG. 6 shows the replacing tool in accordance with another embodiment of the invention. The replacing tool is formed as a tongs-like element having a gripping portion 25 which includes two arms 18 and 19 prestressed toward one another to closed position by a spring 21. The front end of the stationary arm 18 has a projection 23 which engages in the shown operative position in a recess 4d provided in the stripper 4 below the arresting edge 10. Thereby, the catch 5 can be displaced upwardly to its inoperative position in which it does not engage the stripper 4.

The front end of the movable arm 19 carries an abutment face or gripping face 24 which abuts against a respective abutment face of the stripper 4. Since the arms 18 and 19 are prestressed by the spring 21 in direction towards one another, the stripper 4 is clamped between the arms 18 and 19, in the illustrated operative position. Thereby, the stripper 4 can be withdrawn from the stripper shoe 2 by pulling of the gripping portion 25. The insertion of a new stripper is performed in reverse order.

As can be seen from FIGS. 5 and 5A, the opening 16 is provided with a pocket-shaped notch 17 which makes easier the insertion of the pin 14 into the opening 16.

It will be understood that each of the elements described above, or two or more together, may also find a useful application in other types of constructions, differing from the types described above.

While the invention has been illustrated and described as embodied in an arrangement for holding a stripper of a tool and an auxiliary tool for replacing the stripper it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stripper arrangement for a working tool having an axis, such as a revolving tool of a revolving cutting press, comprising a stripper; a stripper shoe arranged to be mounted on a lower side of a tool holder of a tool and having an inner opening for receiving said stripper and a wall which bounds said opening and includes an abutment wall portion, said opening being arranged so that said stripper can be inserted into the same by movement in a plane transverse to the axis of the tool and abut against said abutment wall portion in inserted condition; means for retaining said stripper in said opening of said stripper shoe and including a retaining member which is deflectable in direction from the tool to an operative position in which said retaining member engages with said stripper inserted in said opening of said stripper shoe so as to retain said stripper in said opening, and displaceable to an inoperative position in which said retaining member does not engage said stripper inserted in said opening, so that said stripper can be withdrawn from said opening to be replaced by a new stripper; and means for urging said retaining member so as to deflect the same from the tool to said operative position.

2. An arrangement as defined in claim 1, wherein said opening of said stripper shoe is open in direction downwardly from the tool, and in a direction toward a periphery of said stripper shoe.

3. An arrangement as defined in claim 1, wherein said stripper has an arresting edge, said retaining member having an arresting face arranged to engage with said arresting edge of said stripper in said operative position.

4. An arrangement as defined in claim 1, wherein said stripper has an opposite end wall facing away from said abutment wall portion of said stripper shoe, said retaining member being radially spaced from said abutment wall portion of said stripper shoe and engaging with said end wall of said stripper.

5. An arrangement as defined in claim 1, wherein said stripper has lateral walls, said wall of said stripper shoe having lateral wall portions; and further comprising means for positively movably connecting said lateral walls of said stripper with said lateral wall portions of said wall of said stripper shoe.

6. An arrangement as defined in claim 5, wherein said lateral walls of said stripper are elongated in direction of insertion of said stripper into said opening of said stripper shoe and shaped along their lengths, said lateral wall portions of said wall of said stripper shoe being also shaped complementary to said shaped lateral walls of said stripper so as to engage the same and to thereby form said connecting means.

7. An arrangement as defined in claim 6, wherein said shaped lateral walls of said stripper and said shaped lateral wall portions of said stripper shoe have a cross section which increases in direction transverse to the direction of insertion.

8. An arrangement as defined in claim 7, wherein said cross section of said lateral walls of said stripper and said lateral wall portions of said stripper shoe increases in a stepless manner.

9. An arrangement as defined in claim 7, wherein said cross section of said walls of said stripper and said wall portions of said stripper shoe increases in a stepped manner.

10. An arrangement as defined in claim 1, wherein said stripper has an abutment end wall arranged to abut against said abutment wall portion of said stripper shoe in the inserted condition, said stripper having lateral walls which converge to one another in a substantially trapeze-like manner in direction toward said abutment end wall.

11. An arrangement as defined in claim 1, wherein said retaining member is formed as a catch which is movably mounted on said stripper shoe, said urging means including spring means urging said catch from the tool so that said catch deflects to said operative position to engage said stripper.

12. An arrangement as defined in claim 11; and further comprising means for limiting the deflection of said catch to said operative position to engage said stripper.

13. An arrangement as defined in claim 12, wherein said stripper has an arresting edge, said catch having an arresting face arranged to engage with said arresting edge of said stripper in said operative position, said limiting means including a limiting projection provided on said stripper shoe above said arresting edge of said stripper, and an abutment lug provided on said catch and arranged to abut against said limiting projection during the reflection of the catch to said operative position.

14. An arrangement as defined in claim 1; and further comprising means for displacing said retaining member from said operative position to said inoperative position.

15. An arrangement as defined in claim 14, wherein said displacing means includes an actuating member and a recess provided in said stripper below said arresting edge so that said actuating member can be received into said recess to deflect said retaining member.

16. An arrangement as defined in claim 15, wherein said stripper has a lower side, said actuating member having a front end provided with an abutment face arranged to abut against said lower side of said stripper, and a projection extending toward said stripper and arranged to displace said retaining member from said operative position to said inoperative position when said abutment face of said front end of said actuating member abuts against said lower side of said stripper.

17. An arrangement as defined in claim 16, wherein said actuating member has one gripping portion having said front end provided with said abutment face and said projection.

18. An arrangement as defined in claim 17, wherein said stripper has a through opening extending to said retaining member, said projection of said front end of said gripping portion extending through said through opening of said stripper.

19. An arrangement as defined in claim 18, wherein said stripper has an opposite end wall facing away from said abutment wall portion of said stripper shoe, said gripping portion of said actuating member being provided with at least one second projection which is arranged at said front end in spaced relationship with said first mentioned projection and is engageable with said opposite end wall of said stripper.

20. An arrangement as defined in claim 16, wherein said actuating member is a tongs-type member and has a gripping portion which includes two pivotable gripping arms spring-biased to their closed position, said projection being provided at the front end of one of said arms, whereas said abutment face being provided at the front end of the other of said arms.

21. An arrangement as defined in claim 20, wherein said arms are arranged so that when said abutment face of said actuating member abuts against said lower side of said stripper and said projection of said actuating member displaces said retaining member, said arms of said tongs-like actuating member clampingly grip said stripper.

* * * * *